US007546073B2

(12) United States Patent
Saeki et al.

(10) Patent No.: US 7,546,073 B2
(45) Date of Patent: Jun. 9, 2009

(54) IMAGE FORMING APPARATUS HAVING AN INTERMEDIATE TRANSFER MEMBER WRAPPED AROUND AND DRIVEN BY A PHOTOCONDUCTOR DRUM

(75) Inventors: Tomoya Saeki, Saitama (JP); Noribumi Sato, Saitama (JP); Iwao Kuriki, Saitama (JP); Kazuhiro Saito, Saitama (JP); Toru Tanaka, Kashiwazaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 415 days.

(21) Appl. No.: 11/482,746

(22) Filed: Jul. 10, 2006

(65) Prior Publication Data

US 2007/0127953 A1 Jun. 7, 2007

(30) Foreign Application Priority Data

Dec. 1, 2005 (JP) ..... 2005-348235

(51) Int. Cl.
*G03G 15/01* (2006.01)

(52) U.S. Cl. ..... 399/302

(58) Field of Classification Search ..... 399/227, 399/298, 302, 303

See application file for complete search history.

(56) References Cited

U.S. PATENT DOCUMENTS 6,980,760 B2 * 12/2005 Okamoto et al. ..... 399/227
6,980,761 B2 * 12/2005 Yamada ..... 399/302
7,313,345 B2 * 12/2007 Inaba et al. ..... 399/303

FOREIGN PATENT DOCUMENTS

JP 2003-107843 A 4/2003

* cited by examiner

*Primary Examiner*—William J Royer
(74) *Attorney, Agent, or Firm*—Sughrue Mion, PLLC

(57) ABSTRACT

There is provided an image forming apparatus including: a photoconductor drum; an intermediate transfer belt that is wrapped around and stretched between the photoconductor drum and a plurality of support rolls and is driven by the photoconductor drum; and a contact member that contacts the intermediate transfer belt, wherein the image forming apparatus satisfies the following expression (1)

$$2T(e^{\mu\theta}-1)/(e^{\mu\theta}+1)>F \text{ and } T\leqq 396.9\text{ N} \quad (1),$$

wherein μ represents a coefficient of friction between the photoconductor drum and the intermediate transfer belt, T represents an initial tension of the intermediate transfer belt, θ represents a wrap angle of the intermediate transfer belt on the photoconductor drum, and F represents a load in a tangential direction applied from the contact member to the photoconductor drum via the intermediate transfer belt.

12 Claims, 13 Drawing Sheets

FIG.3

| ITEM | VALUE | FORMULA |
|---|---|---|
| INITIAL TENSION T (N) | 369.9 | |
| TOTAL LOAD P (N) | 571.3 | |
| DISTRIBUTED LOAD p (kg/mm) | 0.18 | |
| OUTER DIAMETER D (mm) | 47.0 | |
| INNER DIAMETER d (mm) | 45.0 | |
| LENGTH L (mm) | 328.0 | |
| GEOMETRICAL MOMENT OF INERTIA I ($mm^4$) | 38241.8 | $\pi D^4/64$ |
| SECTION MODULUS Z ($mm^3$) | 10192.8 | $\pi D^3/32$ |
| MODULUS OF LONGITUDINAL ELASTICITY E ($kg/mm^2$) | $7.00 \times 10^3$ | |
| ALLOWABLE STRESS $\sigma e$ ($kg/mm^2$) | 3.3 | YIELD POINT/4 |
| MAXIMUM DEFLECTION $\omega max$ (mm) | 0.100 | |
| MAXIMUM STRESS $\sigma max$ ($kg/mm^2$) | 0.234 | |
| SAFETY FACTOR | 13.9 | |
| MATERIAL | 1:SUS 2:A5052 | |

FIG.4

| ITEM | VALUE | FORMULA |
|---|---|---|
| INNER CIRCUMFERENCE (mm) | 570.24 | |
| WIDTH (mm) | 340 | |
| THICKNESS (mm) | 0.55 | |
| 100% ELONGATION STRESS (MPa) | 2.8～3.8 | |
| RUPTURE STRENGTH (MPa) | ≧10 | |
| TEARING STRENGTH (KN/m) | ≧20KN/m | |
| ELONGATION (%) | ≧300 | |
| Asker-C HARDNESS(° ) | 68～78 | |
| PERMANENT ELONGATION (%) | ≦5 | |
| MATERIAL | CHLOROPRENE + EPDM | |

FIG.10

| TRIAL CONDITIONS (AT END OF LIFESPAN) | NORMAL TEMPERATURE NORMAL HUMIDITY | HIGH TEMPERATURE HIGH HUMIDITY | LOW TEMPERATURE LOW HUMIDITY |
|---|---|---|---|
| COEFFICIENT OF FRICTION $\mu$ (N/N) | 0.183 | 0.283 | 0.162 |
| WRAP ANGLE $\theta$ (deg) | 90 | 90 | 90 |
| WRAP ANGLE $\theta$ (rad) | 1.571 | 1.571 | 1.571 |
| PHOTOCONDUCTOR DIAMETER D (mm) | 47 | 47 | 47 |
| PERIOD OF TIME ELAPSED UNTIL END OF LIFESPAN (MONTHS) | 24 | 24 | 24 |
| PERIOD OF TIME ELAPSED UNTIL END OF LIFESPAN (HOURS) | 17520 | 17520 | 17520 |
| DESIGN LOAD (TANGENTIAL FORCE ON PHOTOCONDUCTOR) F (N) | 15.68 | 15.98 | 15.98 |
| NECESSARY INITIAL TENSION T (N) | 54.92 | 35.82 | 61.92 |
| NECESSARY INITIAL ELONGATION (%) | 4.9 | 5.2 | 3.6 |

FIG.11

| TRIAL CONDITIONS (AT END OF LIFESPAN) | NORMAL TEMPERATURE NORMAL HUMIDITY | HIGH TEMPERATURE HIGH HUMIDITY | LOW TEMPERATURE LOW HUMIDITY |
|---|---|---|---|
| COEFFICIENT OF FRICTION $\mu$ (N/N) | 0.183 | 0.283 | 0.162 |
| WRAP ANGLE $\theta$ (deg) | 90 | 90 | 90 |
| WRAP ANGLE $\theta$ (rad) | 1.571 | 1.571 | 1.571 |
| PHOTOCONDUCTOR DIAMETER D (mm) | 47.0 | 47.0 | 47.0 |
| PERIOD OF TIME ELAPSED UNTIL END OF LIFESPAN (MONTHS) | 24 | 24 | 24 |
| PERIOD OF TIME ELAPSED UNTIL END OF LIFESPAN (HOURS) | 17520 | 17520 | 17520 |
| DESIGN LOAD (TANGENTIAL FORCE ON PHOTOCONDUCTOR) F (N) | 15.68 | 15.98 | 15.98 |
| ELECTROSTATIC ADSORPTION FORCE N (N) | 37.0 | 37.0 | 37.0 |
| EFFECTIVE TENSION (N) RESULTING FROM ELECTROSTATIC ADSORPTION FORCE N | 4.281 | 11.72 | 6.390 |
| NECESSARY INITIAL TENSION T (N) | 29.44 | 9.055 | 36.71 |
| NECESSARY INITIAL ELONGATION (%) | 2.5 | 2.1 | 1.4 |

IMAGE FORMING APPARATUS HAVING AN INTERMEDIATE TRANSFER MEMBER WRAPPED AROUND AND DRIVEN BY A PHOTOCONDUCTOR DRUM

CROSS-REFERENCE TO RELATED APPLICATION

This application claims priority under 35 USC 119 from Japanese Patent Application No. 2005-348235, the disclosure of which is incorporated by reference herein.

BACKGROUND

1. Technical Field

The present invention relates to an image forming apparatus disposed with an intermediate transfer belt that is wrapped around and stretched between plural support rolls and a photoconductor drum and is driven by the photoconductor drum.

2. Related Art

In 4-cycle full-color laser printers that use a single photoconductor drum to form a full-color toner image comprising yellow (Y), magenta (M), cyan (C), and black (K) on an intermediate transfer belt, the intermediate transfer belt is rotated to complete four laps, and the toner images are superposed one color at a time on the intermediate transfer belt each time the intermediate transfer belt completes one lap. At this time, in order to mutually align the plural toner images to be superposed on the intermediate transfer belt with high precision so as to suppress color shift, it becomes crucial to suppress fluctuations in the relative speed of the intermediate transfer belt with respect to the photoconductor drum and to suppress unevenness in pitch of the plural toner images to be superposed on the intermediate transfer belt, and various measures have been devised thus far.

SUMMARY OF THE INVENTION

According to an aspect of the invention, there is provided an image forming apparatus including: a photoconductor drum; an intermediate transfer belt that is wrapped around and stretched between the photoconductor drum and a plurality of support rolls and is driven by the photoconductor drum; and a contact member that contacts the intermediate transfer belt, wherein the image forming apparatus satisfies the following expression (1)

$$2T(e^{\mu\theta}-1)/(e^{\mu\theta}+1)>F \text{ and } T\leqq 396.9\text{ N} \quad (1),$$

wherein μ represents the coefficient of friction between the photoconductor drum and the intermediate transfer belt, T represents the initial tension of the intermediate transfer belt, θ represents the wrap angle of the intermediate transfer belt on the photoconductor drum, and F represents the load in a tangential direction applied from the contact member to the photoconductor drum via the intermediate transfer belt.

BRIEF DESCRIPTION OF THE DRAWINGS

An exemplary preferred embodiment of the present invention will be described in detail based on the following figures, wherein:

FIG. 3 is a chart showing the material, dimensions, and strength of a photoconductor drum in the image forming apparatus pertaining to the exemplary embodiment of the present invention;

FIG. 4 is a chart showing the material, dimensions, and strength of the intermediate transfer belt in the image forming apparatus pertaining to the exemplary embodiment of the present invention;

FIG. 10 is a chart showing conditions for testing the necessary initial tension and the necessary initial elongation of the intermediate transfer belt in the image forming apparatus pertaining to the exemplary embodiment of the present invention;

FIG. 11 is a chart showing conditions for testing the necessary initial tension and the necessary initial elongation of the intermediate transfer belt in the image forming apparatus pertaining to the exemplary embodiment of the present invention;

DETAILED DESCRIPTION

Next, an exemplary embodiment of the present invention will be described on the basis of the drawings.

Figure 1:
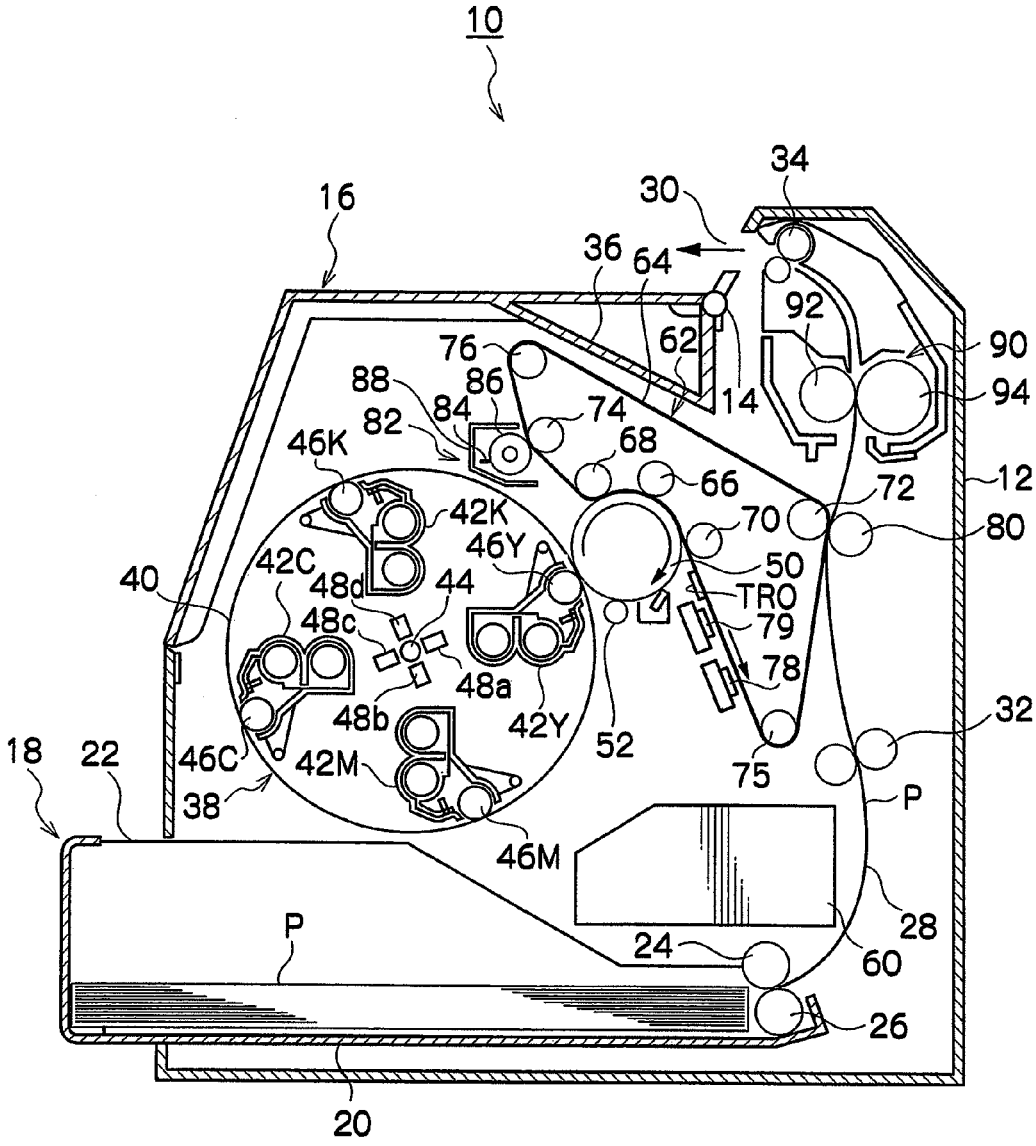
FIG. 1 is a schematic sectional view showing an image forming apparatus pertaining to the exemplary embodiment of the present invention.

FIG. 1 shows an image forming apparatus 10 pertaining to the exemplary embodiment of the present invention. The image forming apparatus 10 includes an image forming apparatus body 12. An open/close cover 16 that is pivotable around a pivot support point 14 is disposed on an upper portion of the image forming apparatus body 12. A paper supply unit 18 of one level, for example, is disposed in a lower portion of the image forming apparatus body 12.

The paper supply unit 18 includes a paper supply unit body 20 and a paper supply cassette 22 in which paper P is accommodated. A feed roll 24, which feeds the paper P from the paper supply cassette 22, and a retard roll 26, which sorts the fed paper P one sheet at a time, are disposed in the upper vicinity of the deep end of the paper supply cassette 22.

A conveyance path 28 is a paper path from the feed roll 24 to a discharge port 30. The conveyance path 28 is formed in the vicinity of the back side (right side in FIG. 1) of the image forming apparatus body 12 substantially vertically from the paper supply unit 18 to a later-described fixing device 90. A later-described secondary transfer roll 80 and a later-described secondary transfer backup roll 72 are disposed upstream of the fixing device 90 on the conveyance path 28. A registration roll 32 is disposed upstream of the secondary transfer roll 80 and the secondary transfer backup roll 72. Further, a discharge roll 34 is disposed in the vicinity of the discharge port 30 of the conveyance path 28.

The paper P is fed by the feed roll 24 from the paper supply cassette 22 of the paper supply unit 18 and sorted by the retard roll 26 such that just the uppermost sheet of paper P is guided to the conveyance path 28. The paper P is temporarily stopped by the registration roll 32 and then passed at a timing between the later-described secondary transfer roll 80 and secondary transfer backup roll 72, where a toner image is transferred to the paper P. Then, the fixing device 90 fixes the transferred toner image to the paper P, and the paper P is discharged by the discharge roll 34 from the discharge port 30 to a discharge unit 36 disposed in the upper portion of the open/close cover 16. The portion of the discharge unit 36 near the discharge port 30 is low, and the discharge unit 36 slants such that it gradually becomes higher toward the front direction (left direction in FIG. 1).

A rotary developing device 38 is disposed in the substantially central portion, for example, of the image forming apparatus body 12. The rotary developing device 38 includes a developer body 40 disposed with developers 42Y to 42K that respectively form toner images of the four colors of yellow (Y), magenta (M), cyan (C), and black (K), and the rotary developing device 38 rotates leftward (counter-clockwise in FIG. 1) around a rotary developing device center 44. The developers 42Y, 42M, 42C, and 42K respectively include developing rolls 46Y, 46M, 46C, and 46K and are pressed in the normal line direction of the developer body 40 by elastic bodies 48*a* to 48*d* such as coil springs, for example.

A photoconductor drum 50 that rotates around a rotational support shaft, for example, contacts the rotary developing device 38, and the developing rolls 46Y, 46M, 46C, and 46K are disposed such that part of their outer peripheries protrude (e.g., 2 mm) in the radial direction from the outer periphery of the developer body 40 in a state where they are not contacting the photoconductor drum 50. Further, tracking rolls (not shown) that have diameters slightly larger than the diameters of the developing rolls 46Y, 46M, 46C, and 46K are disposed at both ends of each of the developing rolls 46Y, 46M, 46C, and 46K such that the tracking rolls rotate coaxially with the developing rolls 46Y, 46M, 46C, and 46K. In other words, the developing rolls 46Y, 46M, 46C, and 46K of the developers 42Y, 42M, 42C, and 42K center around the rotary developing device center 44 and are disposed at the outer periphery of the developer body 40 at 90° intervals, the tracking rolls of the developing rolls 46Y, 46M, 46C, and 46K contact flanges (not shown) disposed on both ends of the photoconductor drum 50 to form predetermined gaps between the developing rolls 46Y, 46M, 46C, and 46K and the photoconductor drum 50, and the developing rolls 46Y, 46M, 46C, and 46K develop the latent image on the photoconductor drum 50 with toners of the respective colors.

A charge device 52 including a charge roll, for example, that uniformly charges the photoconductor drum 50 is disposed below the photoconductor drum 50. Further, an exposure device 60 that uses a light beam such as a laser beam to write the latent image onto the photoconductor drum 50 charged by the charge device 52 is disposed at the rear side of, and below, the rotary developing device 38. Further, an intermediate transfer device 62, which primarily transfers the toner images visualized by the rotary developing device 38 at a primary transfer position and conveys the toner images to a later-described secondary transfer position, is disposed above the rotary developing device 38.

The intermediate transfer device 62 includes an intermediate transfer belt 64, a primary transfer roll 66, a wrap-in roll 68, a wrap-out roll 70, the secondary transfer backup roll 72, a brush backup roll 74, and tension rolls 75 and 76.

The intermediate transfer belt 64 has elasticity and is stretched substantially flatly above the rotary developing device 38. The edge of the upper surface side of the intermediate transfer belt 64 is stretched such that the edge is substantially parallel to the discharge unit 36 disposed in the upper portion of the image forming apparatus body 12, for example. Further, the intermediate transfer belt 64 includes a primary transfer portion (photoconductor drum wrap region) that contacts the photoconductor drum 50 in a wrapped manner between the wrap-in roll 68 disposed upstream of the primary transfer roll 66 under the intermediate transfer belt 64 and the wrap-out roll 70 disposed downstream of the primary transfer roll 66, and the intermediate transfer belt 64 is wrapped around a predetermined range of the photoconductor drum 50 so as to be driven by the rotation of the photoconductor drum 50. For this reason, a dedicated drive source for causing the intermediate transfer belt 64 to be rotatingly driven becomes unnecessary, so that costs can be reduced.

In this manner, the toner images on the photoconductor drum 50 are superposed and primarily transferred by the primary transfer roll 66 to the intermediate transfer belt 64 in the order of yellow (Y), magenta (M), cyan (C), and black (K), for example, and the intermediate transfer belt 64 conveys the primarily transferred toner images to the later-described secondary transfer roll 80. It will be noted that the wrap-in roll 68 and the wrap-out roll 70 are separated from the photoconductor drum 50.

Further, the intermediate transfer belt 64 is stretched by the six rolls including the wrap-in roll 68, the wrap-out roll 70, the secondary transfer backup roll 72, the brush backup roll 74, and the tension rolls 75 and 76, and the toner images on the photoconductor drum 50 are transferred to the intermediate transfer belt 64 by the primary transfer roll 66.

Moreover, a planar portion is formed at the back side (surface at the right side in FIG. 1) of the intermediate transfer belt 64 by the tension roll 75 and the secondary transfer backup roll 72. This planar portion is configured such that it serves as a secondary transfer portion and merges with the conveyance path 28.

The brush backup roll 74 assists a brush roll 86 in scraping off waste toner remaining on the intermediate transfer belt 64 after secondary transfer.

Sensors 78 and 79, such as reflective photosensors, for example, are disposed below the intermediate transfer belt 64.

The sensor 78 detects the density of the toner by reading the patches of the toner formed on the intermediate transfer belt 64. Further, the sensor 79 detects the position of a belt position detection mark TR0 formed on the intermediate transfer belt 64.

The secondary transfer roll 80 faces the secondary transfer backup roll 72 of the intermediate transfer device 62 with the conveyance path 28 sandwiched therebetween. In other words, the space between the secondary transfer roll 80 and the secondary transfer backup roll 72 serves as a secondary transfer position in the secondary transfer portion. The secondary transfer roll 80 is assisted by the secondary transfer backup roll 72 in secondarily transferring the toner images primarily transferred to the intermediate transfer belt 64 to the paper P at the secondary transfer position.

Here, the secondary transfer roll 80 is configured to separate from the intermediate transfer belt 64 during a period of time when the intermediate transfer belt 64 completes three rotations—that is, during the period of time when the intermediate transfer belt 64 conveys the toner images of the three colors of yellow (Y), magenta (M), and cyan (C)—and to contact the intermediate transfer belt 64 after the toner image of black (K) has been transferred.

It will be noted that the space between the secondary transfer roll 80 and the secondary transfer backup roll 72 is configured such that a predetermined electric potential difference arises, and when the secondary transfer roll 80 is given a high voltage, for example, the secondary transfer backup roll 72 is ground (GND).

An intermediate transfer belt cleaner 82 is disposed in the vicinity of the intermediate transfer belt 64. The intermediate transfer belt cleaner 82 includes a scraper 84, the brush roll 86, and a toner recovery bottle 88, and swings around a rotational support shaft. The brush roll 86 scrapes off the waste toner on the intermediate transfer belt 64. The scraper 84 scrapes and cleans off the waste toner adhering to the brush roll 86. The toner recovery bottle 88 recovers the toner scraped off by the scraper 84. The scraper 84 is composed of a thin plate of stainless steel, for example.

The brush roll 86 is composed of a brush made of acrylic or the like that has been treated to make it electrically conductive, for example. Additionally, the brush roll 86 is configured to separate from the intermediate transfer belt 64 during the period of time when the intermediate transfer belt 64 conveys the toner images and to contact the intermediate transfer belt 64 at a predetermined timing.

The fixing device 90 is disposed above the secondary transfer position. The fixing device 90 includes a heat roller 92 and a pressure roller 94, causes the toner images secondarily transferred to the paper P by the secondary transfer roll 80 and the secondary transfer backup roll 72 to be fixed to the paper P, and conveys the paper P to the discharge roll 34.

Incidentally, it is necessary for the plural toner images to be superposed on the intermediate transfer belt 64 to be mutually aligned with high precision, and for this reason, conditions such as the tension of the intermediate transfer belt 64 must be set such that the intermediate transfer belt 64 which is driven by the photoconductor drum 50 does not slip with respect to the photoconductor drum 50. This point will be described below.

Figure 2:
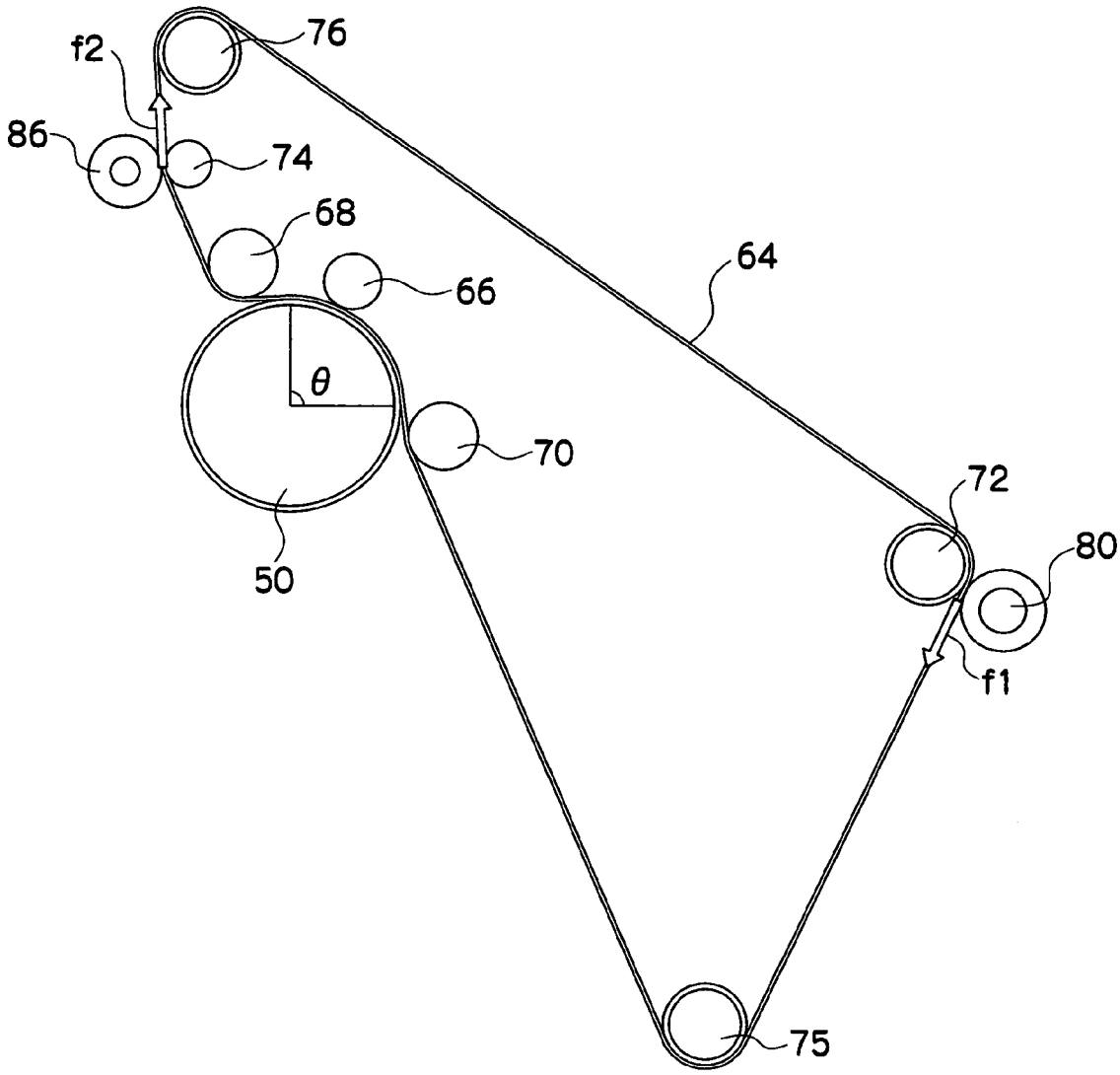
FIG. 2 is a sectional view showing the stretched state of an intermediate transfer belt in the image forming apparatus pertaining to the exemplary embodiment of the present invention.

As shown in FIG. 2, the secondary transfer roll 80 and the brush roll 86 contact the intermediate transfer belt 64, and loads f1 and f2 from the secondary transfer roll 80 and the brush roll 86 to the photoconductor drum 50 via the intermediate transfer belt 64 are respectively applied to the intermediate transfer belt 64 in the tangential directions of the photoconductor drum 50.

Further, the intermediate transfer belt 64 is wrapped around the photoconductor drum 50 at a wrap angle θ and is driven to rotate the photoconductor drum 50 due to the frictional force with the photoconductor drum 50. The coefficient of friction between the intermediate transfer belt 64 and the photoconductor drum 50 when the intermediate transfer belt 64 is driven to rotate the photoconductor drum 50 will be represented by μ. Further, an initial tension T is imparted to the intermediate transfer belt 64 at the point in time prior to rotation in order for the intermediate transfer belt 64 to be caused by the frictional force with the photoconductor drum 50 to rotate following the photoconductor drum 50. Further, a load F (=f1+f2) in the tangential direction of the photoconductor drum 50 acts on the photoconductor drum 50 from the secondary transfer roll 80 and the brush roll 86 via the intermediate transfer belt 64 when the intermediate transfer belt 64 is driven to rotate the photoconductor drum 50.

Here, in order to ensure that the intermediate transfer belt 64 does not slip with respect to the photoconductor drum 50, the wrap angle θ, the coefficient of friction μ, the initial tension T, and the load F are set such that they satisfy the following expression (1) based on Euler's belt theory.

$$2T(e^{\mu\theta}-1)/(e^{\mu\theta}+1)>F \quad (1)$$

Here, the initial tension T is set in consideration of the deflection of the photoconductor drum 50. About 0.1 mm is reasonable for the allowable value of the deflection of the photoconductor drum 50 in consideration of the allowable amount of deformation in the sub-scanning direction in a straight line in the main scanning direction usually called BOW, and because the material, dimensions, and strength of the photoconductor drum 50 used in the present exemplary embodiment are as shown in the chart of FIG. 3, the initial tension T is set to 4.13 N or less.

Further, an electrostatic suction force N arises between the photoconductor drum 50 and the intermediate transfer belt 64 due to applied voltage at the time the toner images are primarily transferred from the photoconductor drum 50 to the intermediate transfer belt 64. Because this electrostatic suction force N also contributes to suppressing slippage of the intermediate transfer belt 64 with respect to the photoconductor drum 50, the wrap angle θ, the coefficient of friction μ, the initial tension T, the load F, and the electrostatic suction force N may also be set such that they satisfy the following expression (2). In this case, the applicable range of the initial tension T can be widened in comparison to the above expression (1).

$$2T(e^{\mu\theta}-1)/(e^{\mu\theta}+1)+N(e^{\mu\theta}-1)/\theta>F \quad (2)$$

Incidentally, the above expressions (1) and (2) must be stably satisfied regardless of temporal changes in the intermediate transfer belt 64 and fluctuations in the working environment. For this reason, it is necessary to set the initial tension T in consideration of a drop in the initial tension T resulting from creep deformation of the intermediate transfer belt 64 and fluctuations in the coefficient of friction μ resulting from environmental fluctuations. This point will be described below.

First, the intermediate transfer belt 64 is stretched between the rolls 66, 68, 70, 72, and 74-76, and the change in the initial tension T over time is measured. As a characteristic of the intermediate transfer belt 64 exemplified in the present exemplary embodiment, it is apparent from preliminary tests that the characteristic of the change in the initial tension T changes due to initial stretch conditions (initial elongation) and working environment conditions (temperature and humidity). Thus, the initial tension T is measured by changing the initial stretch conditions and environment conditions.

It is apparent from preliminary tests that the characteristic of the change in the initial tension T does not change whether or not the intermediate transfer belt 64 is rotatingly driven while it is stretched.

Further, the initial elongation refers to the percentage of increase in the circumference of the intermediate transfer belt 64, from its initial state when the intermediate transfer belt 64 is in a natural state (an unstretched state) in normal temperature and humidity to the state when it is stretched between the rolls 66, 68, 70, 72, and 74-76. When the circumference of the intermediate transfer belt 64 in the natural state is 100% and the circumference of the intermediate transfer belt 64 in the stretched state is 102%, then the initial elongation becomes 2% (=102%−100%).

Further, in the following tests, the normal temperature normal humidity environment is 22° C. with 55% relative humidity (RH), the high temperature high humidity environment is 28° C. with 85% relative humidity (RH), and the low temperature low humidity environment is 10° C. with 15% relative humidity (RH).

Further, the material, dimensions, and strength of the intermediate transfer belt 64 used in these tests are as shown in the chart of FIG. 4.

Figure 5:
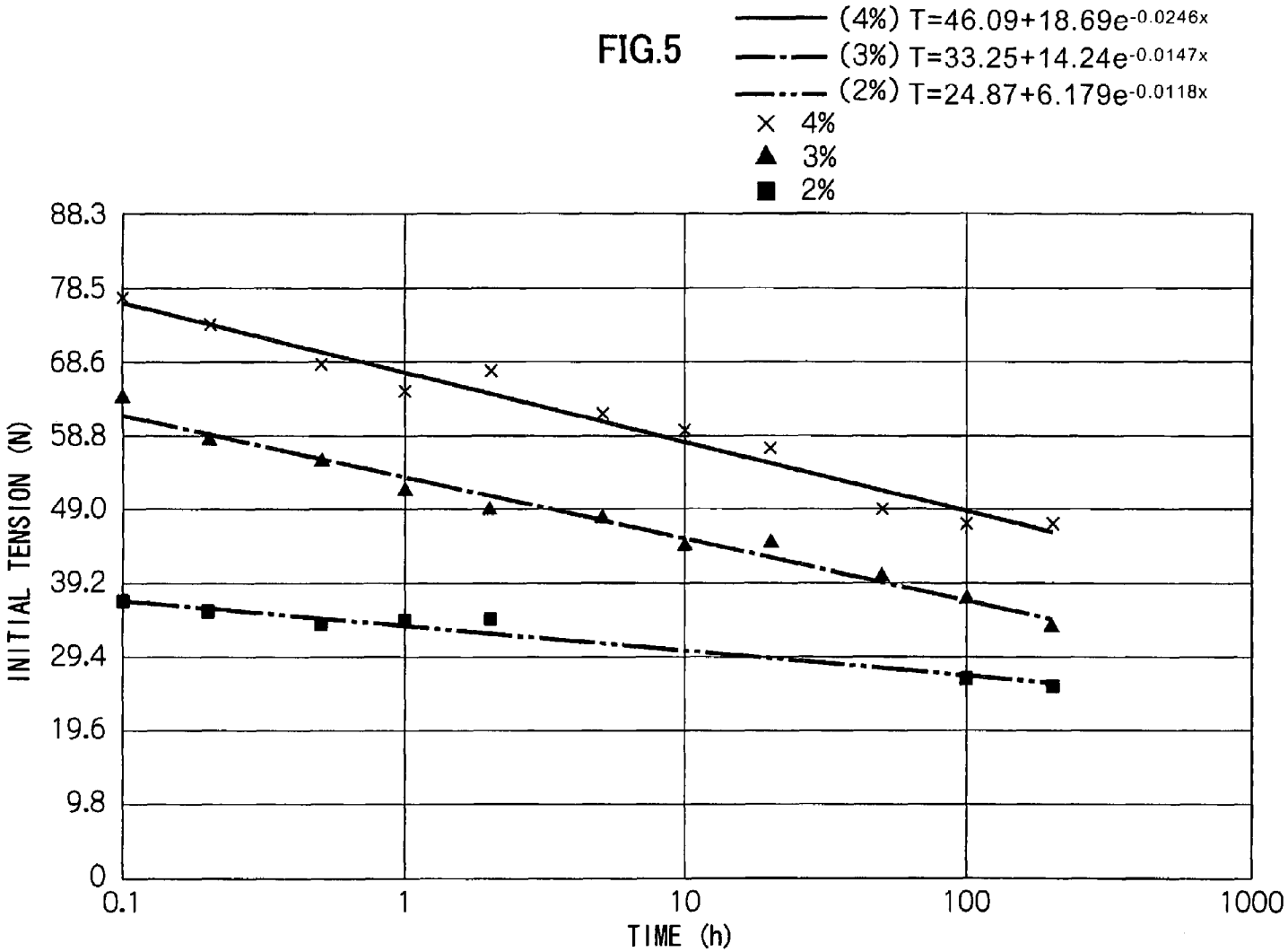
FIG. 5 is a graph showing the relationship (under normal temperature and normal humidity) between the stretched time and the deterioration over time of the initial tension of the intermediate transfer belt in the image forming apparatus pertaining to the exemplary embodiment of the present invention.

First, under normal temperature and normal humidity, the intermediate transfer belt 64 is rotated for 200 hours, with the initial elongation being set to 2%, 3%, and 4%, and the changes in the initial tension T during this time are measured. The measurement results are as shown in the graph of FIG. 5. Then, a map representing the correlation between the obtained stretch time x and the initial tension T is exponentially approximated. The approximations become like the following expressions (3) to (5).

$$T=46.09+18.69e^{-0.0246x} \text{ (initial elongation 4\%)} \quad (3)$$

$$T=33.25+14.24e^{-0.0147x} \text{ (initial elongation 3\%)} \quad (4)$$

$$T=24.87+6.179e^{-0.0118x} \text{ (initial elongation 2\%)} \quad (5)$$

Figure 6:
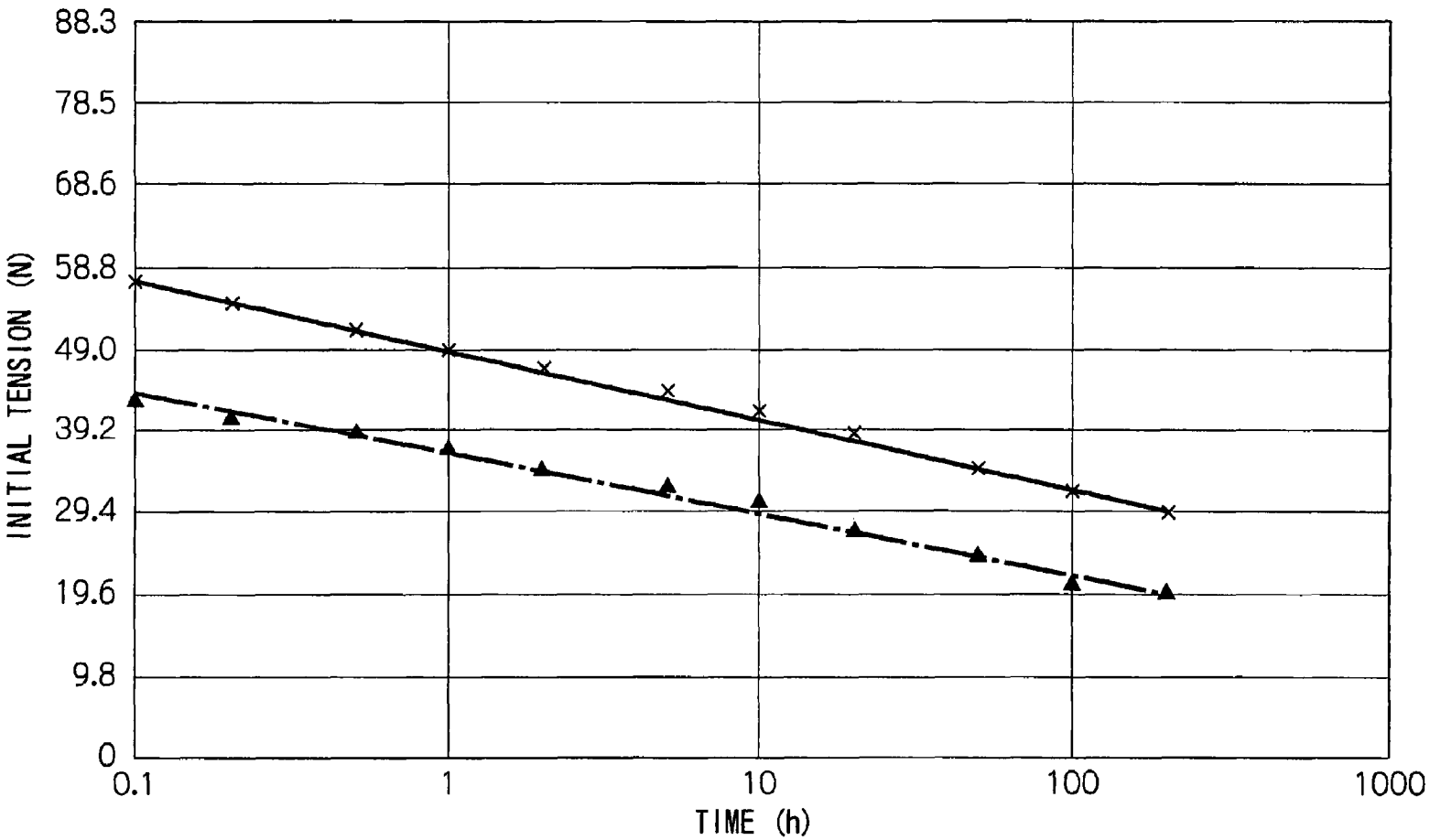
FIG. 6 is a graph showing the relationship (under high temperature and high humidity) between the stretched time and the deterioration over time of the initial tension of the intermediate transfer belt in the image forming apparatus pertaining to the exemplary embodiment of the present invention.

Further, under high temperature and high humidity, the intermediate transfer belt 64 is stretched for one month without being rotatingly driven with the initial elongation being 3% and 4%, and the changes in the initial tension T during this time are measured. The measurement results are as shown in the graph of FIG. 6. Then, a map representing the correlation between the obtained stretch time x and the initial tension T is exponentially approximated. The approximations become like the following expressions (6) and (7).

$$T=25.73+19.23e^{-0.0122x} \text{ (initial elongation 4\%)} \quad (6)$$

$$T=17.15+16.45e^{0.0160x} \text{ (initial elongation 3\%)} \quad (7)$$

Figure 7:
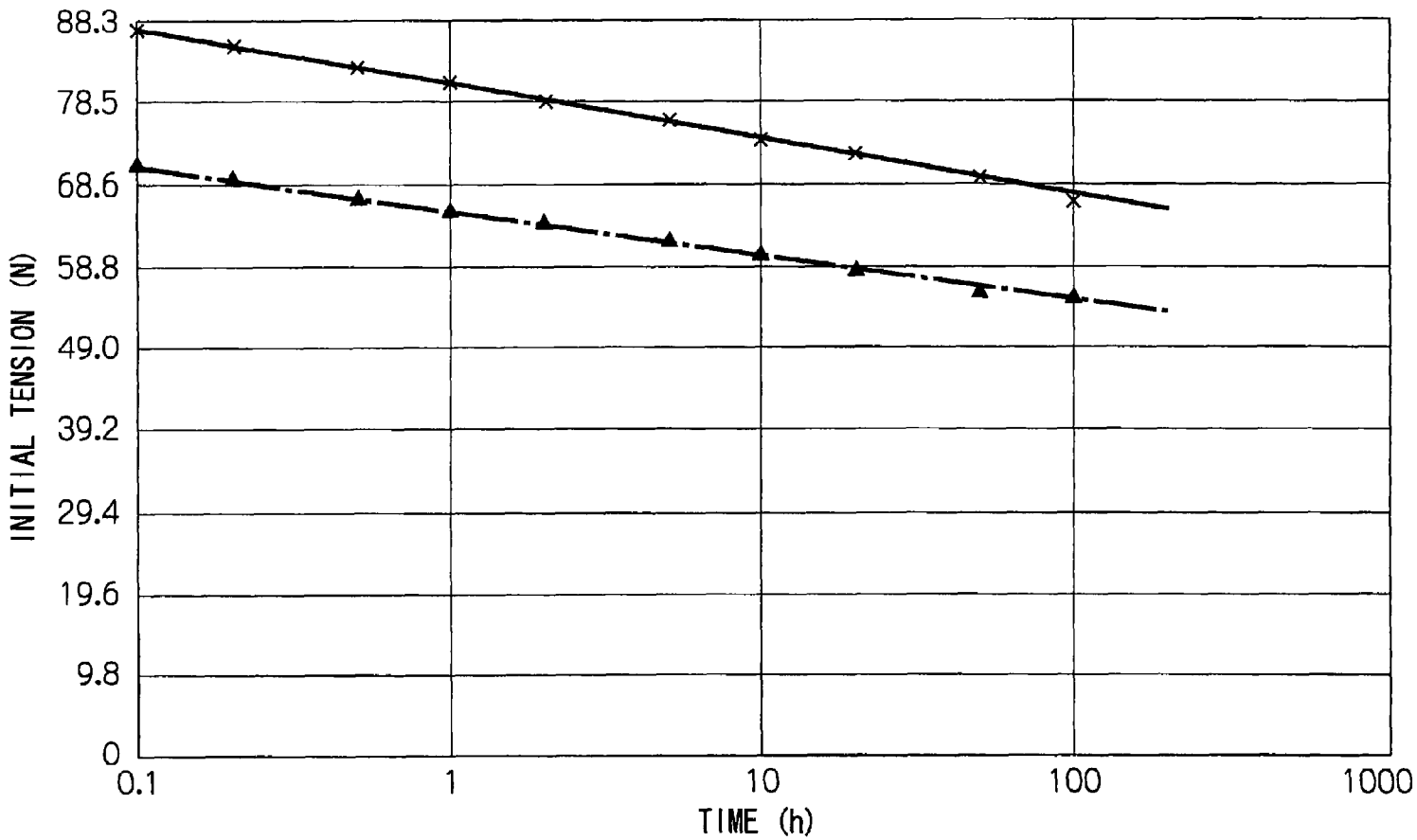
FIG. 7 is a graph showing the relationship (under low temperature and low humidity) between the stretched time and the deterioration over time of the initial tension of the intermediate transfer belt in the image forming apparatus pertaining to the exemplary embodiment of the present invention.

Further, under low temperature and low humidity, the intermediate transfer belt 64 is stretched for one month without being rotatingly driven with the initial elongation being 3% and 4%, and the changes in the initial tension T during this time are measured. The measurement results are as shown in the graph of FIG. 7. Then, a map representing the correlation between the obtained stretch time x and the initial tension T is exponentially approximated. The approximations become like the following expressions (8) and (9).

$$T=67.05+14.64e^{-0.1688x} \text{ (initial elongation 4\%)} \quad (8)$$

$$T=55.28+12.97e^{0.1500x} \text{ (initial elongation 3\%)} \quad (9)$$

Figure 8:
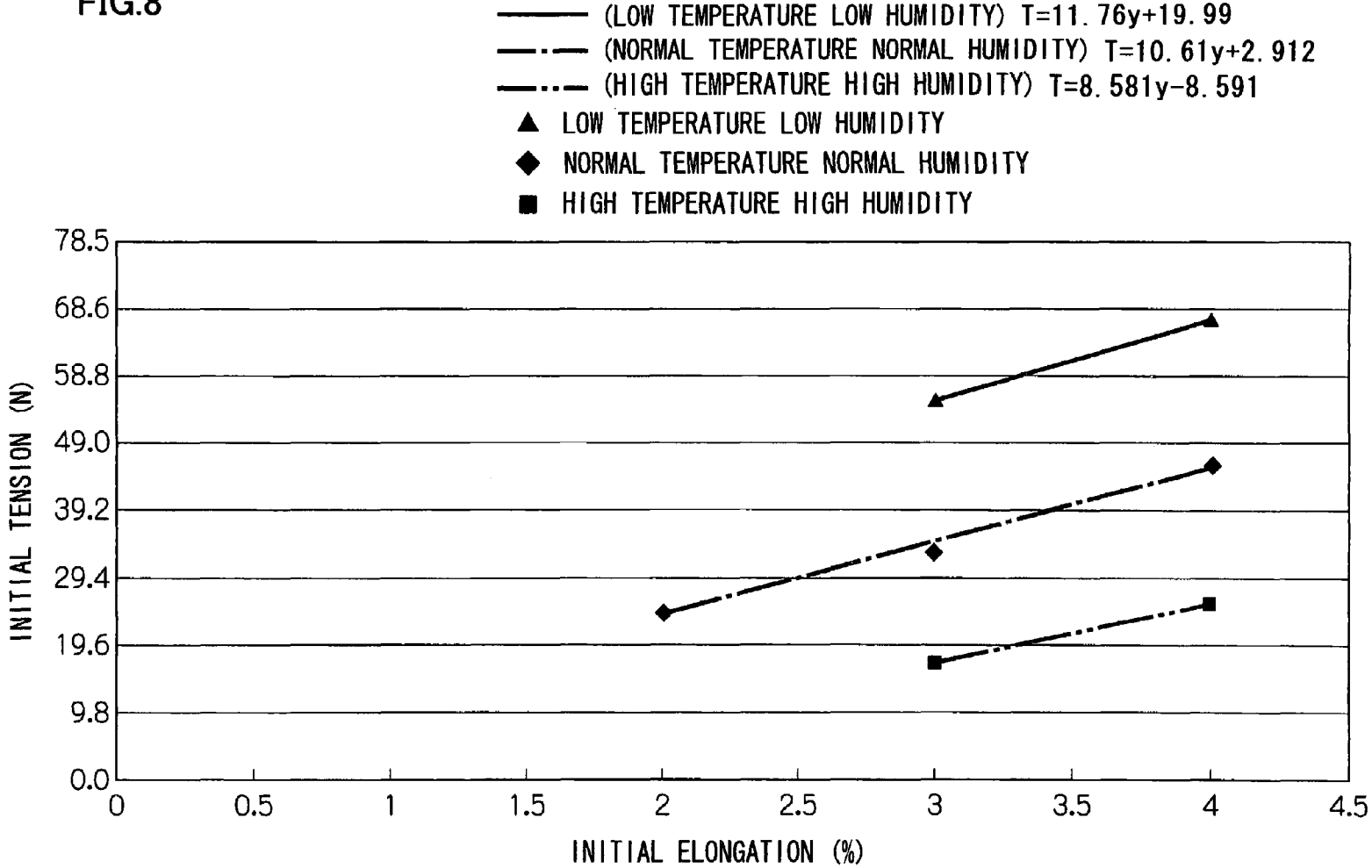
FIG. 8 is a graph showing the relationship between the initial elongation and temporal changes in the initial tension of the intermediate transfer belt in the image forming apparatus pertaining to the exemplary embodiment of the present invention.

Next, the lifespan of the intermediate transfer belt 64 is set to be two years (17,520 hours), and the initial tension T at the end of the lifespan is calculated from the above expressions (3) to (9). The calculation results are as shown in the graph of FIG. 8. Then, a map representing the correlation between the obtained initial elongation y at the end of the lifespan and the initial tension T is exponentially approximated. The approximations become like the following expressions (10) to (12).

$$T=11.76y+19.99 \text{ (low temperature low humidity)} \quad (10)$$

$$T=10.61y+2.912 \text{ (normal temperature normal humidity)} \quad (11)$$

$$T=8.581y-8.591 \text{ (high temperature high humidity)} \quad (12)$$

Usually, log approximation is used when approximating temporal changes such as these. When the stretch tension of the belt is constant, it is appropriate to use log approximation, but when the stretch tension of the belt is imparted by the initial elongation of the belt as described above and changes over time due to the elongation deformation of the belt, it is appropriate to use exponential approximation.

Figure 9:
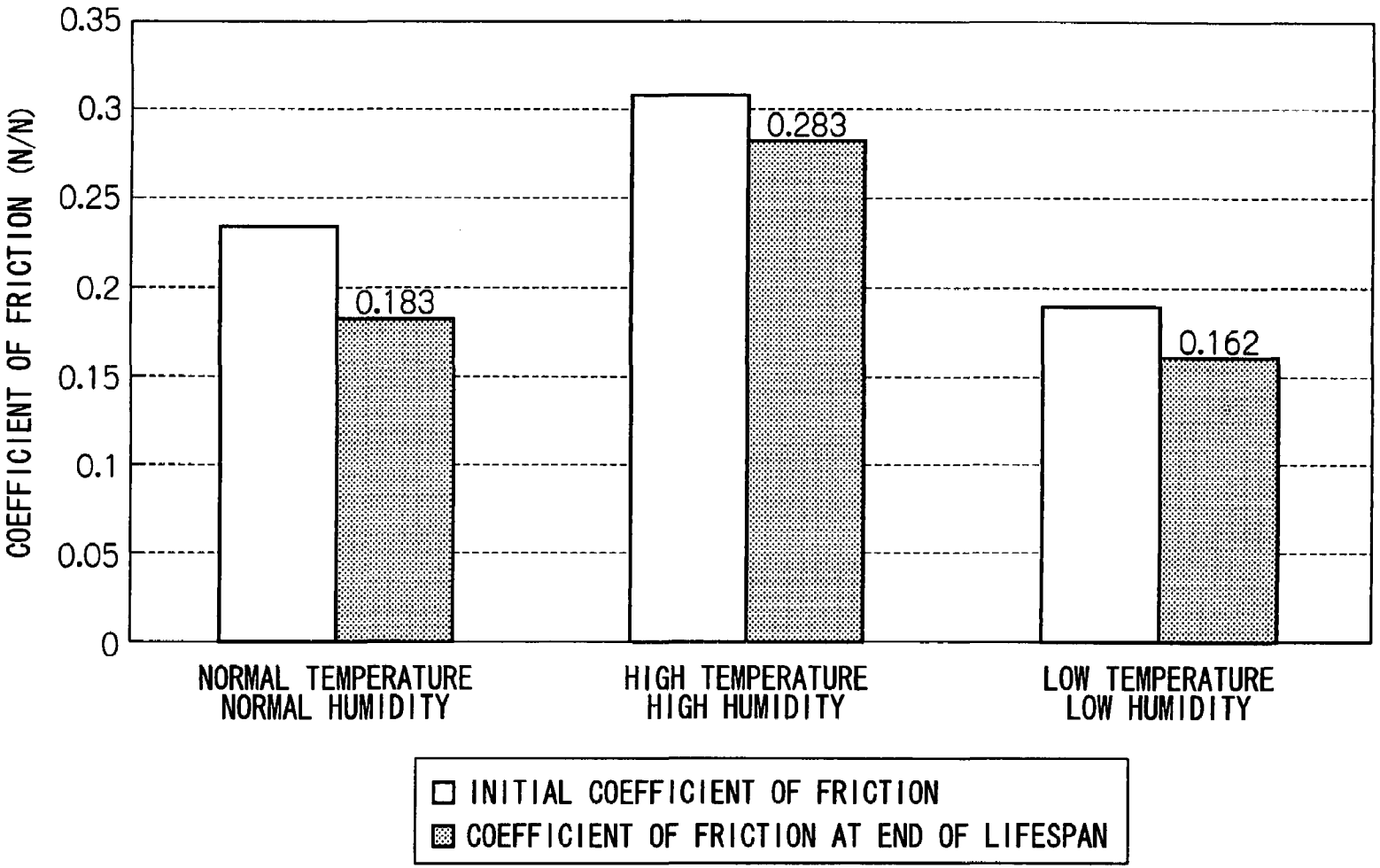
FIG. 9 is a graph showing measurement results of the coefficient of friction between the intermediate transfer belt and the photoconductor drum in the image forming apparatus pertaining to the exemplary embodiment of the present invention.

Next, the coefficient of friction μ between the photoconductor drum 50 and the intermediate transfer belt 64 is measured with the environment conditions being changed to high temperature and high humidity, normal temperature and normal humidity, and low temperature and low humidity. Here, because it is predicted that the coefficient of friction μ will be greatly affected by the temporal changes of the surface state between the photoconductor drum 50 and the intermediate transfer belt 64, when the change in the coefficient of friction μ from when the intermediate transfer belt 64 is brand new to when the intermediate transfer belt 64 has reached the end of its lifespan is measured in the preliminary tests, it is substantiated that the coefficient of friction μ become the lowest when the intermediate transfer belt 64 reaches the end of its lifespan and that the prediction is correct. For this reason, the coefficient of friction μ is measured in the state when the intermediate transfer belt 64 has reached the end of its lifespan, which is the state in which the intermediate transfer belt 64 slips. The measurement results are as shown in the graph of FIG. 9.

Then, the necessary initial tension T is calculated by substituting into the above expression (1) the obtained coefficient of friction μ, the design value (=15.68 N) of the load F in the tangential direction of the photoconductor drum 50, and the wrap angle θ (=1.571 rad). As shown in the chart of FIG. 10, the calculation result becomes 54.92 N under normal temperature and normal humidity, 35.85 N under high temperature and high humidity, and 61.95 N under low temperature and low humidity.

Then, the obtained initial tension T is substituted into the above expressions (10) to (12) to calculate the initial elongation. As shown in the chart of FIG. 10, the calculation result becomes 4.9% under normal temperature and normal humidity, 5.2% under high temperature and high humidity, and 3.6% under low temperature and low humidity.

Consequently, regardless of environmental fluctuations, the initial elongation of the intermediate transfer belt 64 necessary in order to cause the intermediate transfer belt 64 to be stably driven by the photoconductor drum 50 is 5.2% or more.

It will be noted that, as mentioned above, the upper limit of the initial elongation is 37.1% under normal temperature and normal humidity, 47.3% under high temperature and high humidity, and 32.1% under low temperature and low humidity, because the initial tension T is set to 396.9 N or less. Consequently, regardless of the environment, the upper limit of the initial elongation becomes 32.1% in order to set the initial tension T to 4.133 N or less.

On the other hand, when the electrostatic suction force N arising between the photoconductor drum 50 and the intermediate transfer belt 64 is taken into consideration, the necessary initial tension T is calculated by substituting into the above expression (2) the obtained coefficient of friction μ, the design value (=15.68 N) of the load F in the tangential direction of the photoconductor drum 50, the wrap angle θ (=1.571 rad), and the electrostatic suction force (=37.0 N). As shown in the chart of FIG. 11, the calculation result becomes 29.44 N under normal temperature and normal humidity, 9.055 N under high temperature and high humidity, and 36.71 N under low temperature and low humidity.

Then, the obtained initial tension T is substituted into the above expressions (10) to (12) to calculate the initial elongation. As shown in the chart of FIG. 1, the calculation result becomes 2.5% under normal temperature and normal humidity, 2.1% under high temperature and high humidity, and 1.4% under low temperature and low humidity.

Consequently, regardless of environmental fluctuations, the initial elongation of the intermediate transfer belt 64 necessary in order to cause the intermediate transfer belt 64 to be stably driven by the photoconductor drum 50 is 2.5% or more.

As described above, by setting the initial elongation of the intermediate transfer belt 64 to 5.2% or more when the electrostatic suction force N is not considered, the initial tension T of the intermediate transfer belt 64 satisfies the above expression (1) and the intermediate transfer belt 64 is stably driven by the photoconductor drum 50, regardless of temporal changes until the end of the normal lifespan and fluctuations in temperature and humidity in the normal working environment of the apparatus. Further, by setting the initial elongation of the intermediate transfer belt 64 to 2.5% or more when the electrostatic suction force N is considered, the initial tension T of the intermediate transfer belt 64 satisfies the above expression (2) and the intermediate transfer belt 64 is stably driven by the photoconductor drum 50, regardless of temporal changes until the end of the normal lifespan and fluctuations in temperature and humidity in the normal working environment of the apparatus.

Incidentally, unevenness in the circumferential speed of the photoconductor drum 50 resulting from the eccentricity of the photoconductor drum 50 can be cited as another factor that inhibits high-precision mutual alignment of the plural toner images to be superposed on the intermediate transfer belt 64.

Figure 12:
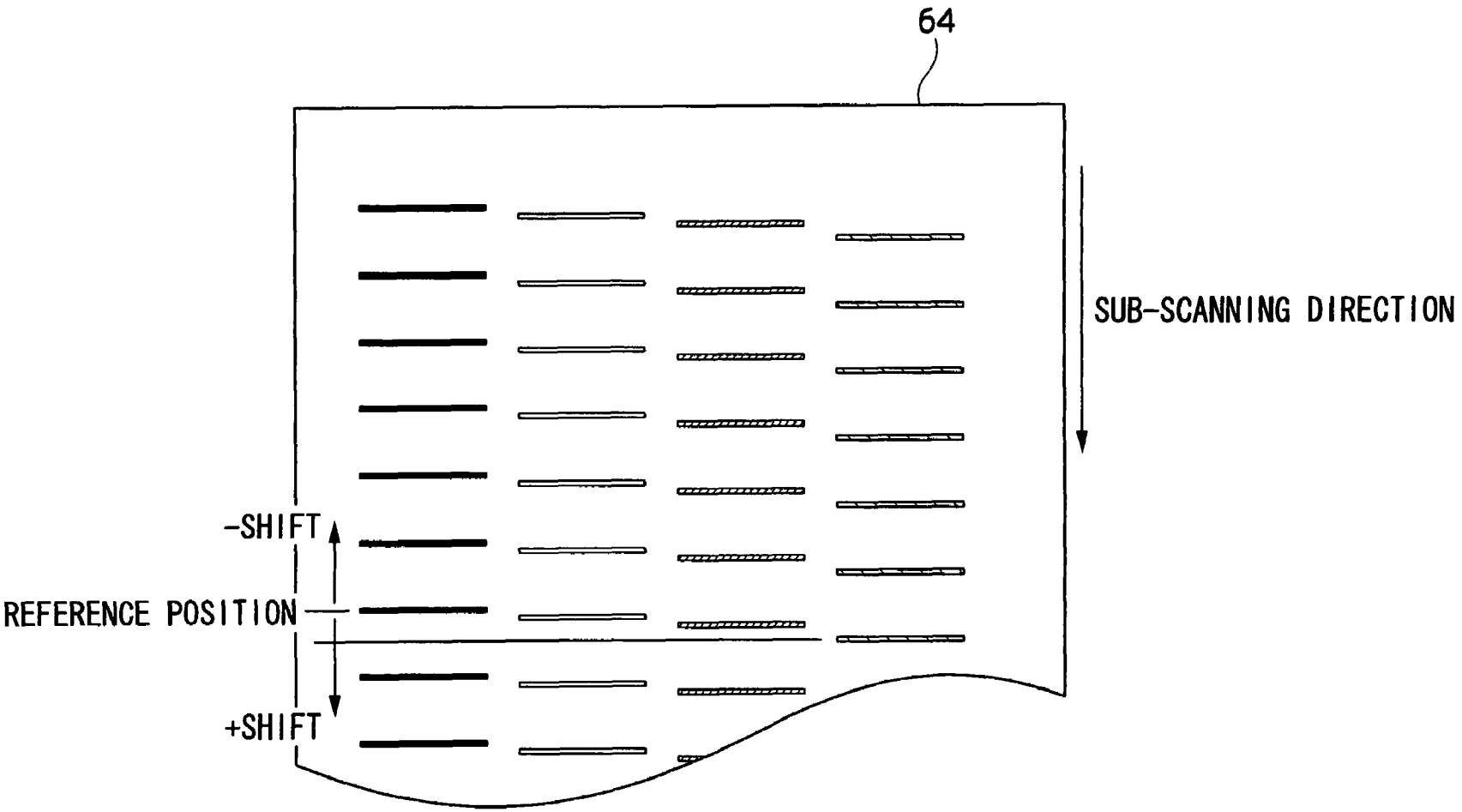
FIG. 12 is a schematic diagram for describing the shift in toner images that have been primarily transferred onto the intermediate transfer belt.

Because a certain amount of eccentricity that is allowable in terms of manufacturing precision is present not only in the photoconductor drum 50 but also in roll-like rotators, speed unevenness in one rotational cycle arises in the circumferential speed even if the rotational speed is constant. For this reason, in the case of the photoconductor drum 50, the pitch unevenness in the sub-scanning direction arises at the stage of exposure, and as shown in FIG. 12, the pitch unevenness in the sub-scanning direction arises in the toner images that have been primarily transferred to the intermediate transfer belt 64.

Figure 13A:
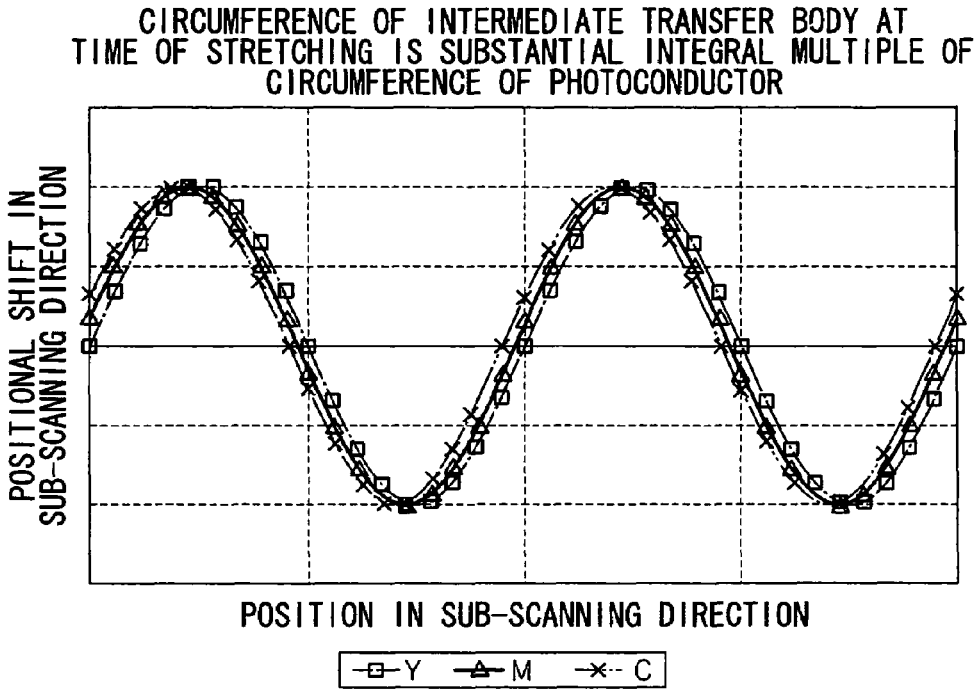
FIG. 13A is a graph showing the amount of positional shift of the toner images in a sub-scanning direction when the circumference of the intermediate transfer belt at the time of being stretched is an integral multiple of the circumference of the photoconductor drum.

Here, by setting the circumference of the intermediate transfer belt 64 such that it is an integral multiple of the circumference of the photoconductor drum 50 in a state where the intermediate transfer belt 64 is wrapped around the wrap-in roll 68, the wrap-out roll 70, the secondary transfer backup roll 72, the brush backup roll 74, the tension rolls 75 and 76, and the photoconductor drum 50, the phases of the pitch unevenness of plural toner images to be superposed align (see the graph in FIG. 13A). Thus, the positional shift between the plural toner images to be superposed is suppressed.

Figure 13B:
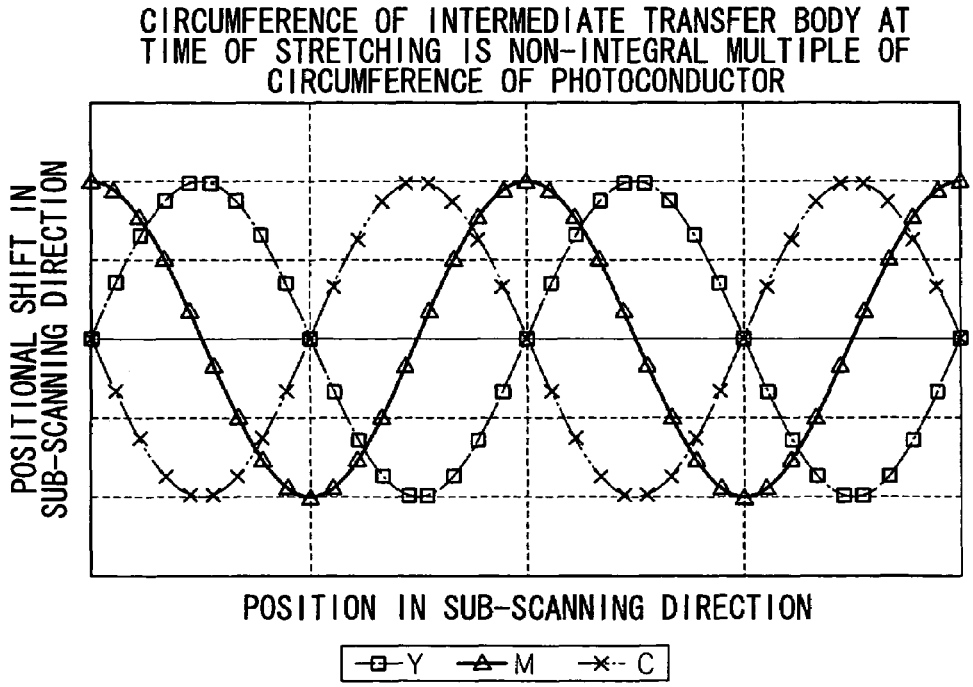
FIG. 13B is a graph showing the amount of positional shift of the toner images in the sub-scanning direction when the circumference of the intermediate transfer belt is a non-integral multiple of the circumference of the photoconductor drum.

On the other hand, if the circumference of the intermediate transfer belt 64 is set such that it is a non-integral multiple of the circumference of the photoconductor drum 50 in a state where the intermediate transfer belt 64 is wrapped around the wrap-in roll 68, the wrap-out roll 70, the secondary transfer backup roll 72, the brush backup roll 74, the tension rolls 75 and 76, and the photoconductor drum 50, the phases of the pitch unevenness of the plural toner images to be superposed are shifted (see the graph in FIG. 13B). For this reason, positional shift between the plural toner images to be superposed occurs.

Consequently, in the present exemplary embodiment, the circumference of the intermediate transfer belt 64 is set such that it is an integral multiple of the circumference of the photoconductor drum 50 in a state where the intermediate transfer belt 64 is wrapped around the wrap-in roll 68, the wrap-out roll 70, the secondary transfer backup roll 72, the brush backup roll 74, the tension rolls 75 and 76, and the photoconductor drum 50.

Here, in order to generate the initial tension T in the intermediate transfer belt 64, usually at least one stretch roll is made pivotable and the intermediate transfer belt is biased by a spring or the like. In this case, the initial tension T can be maintained at a constant, but the stretch roll ends up pivoting and the circumference of the intermediate transfer belt ends up changing. For this reason, the circumference of the intermediate transfer belt at the time of stretching cannot be maintained at an integral multiple of the circumference of the photoconductor drum.

Thus, in the present exemplary embodiment, the positions of the rotational shafts of the wrap-in roll 68, the wrap-out roll 70, the secondary transfer backup roll 72, the brush backup roll 74, and the tension rolls 75 and 76 are made immovable and the intermediate transfer belt 64 is elastically deformed at the time of stretching, whereby the initial tension T is generated in the intermediate transfer belt 64. Thus, the circumference of the intermediate transfer belt 64 at the time of stretching can be maintained at an integral multiple of the circumference of the photoconductor drum 50, and the positional shift between the plural toner images to be superposed on the intermediate transfer belt 64 can be suppressed.

What is claimed is:

1. An image forming apparatus comprising:

a photoconductor drum;

an intermediate transfer belt that is wrapped around and stretched between the photoconductor drum and a plurality of support rolls and is driven by the photoconductor drum; and a contact member that contacts the intermediate transfer belt, wherein the image forming apparatus satisfies the following expression (1)

$$2T(e^{\mu\theta}-1)/(e^{\mu\theta}+1)>F \text{ and } T\leqq 396.9 \text{ N} \quad (1),$$

wherein

μ represents a coefficient of friction between the photoconductor drum and the intermediate transfer belt, T represents an initial tension of the intermediate transfer belt, θ represents a wrap angle of the intermediate transfer belt on the photoconductor drum, and F represent a load in a tangential direction applied from the contact member to the photoconductor drum via the intermediate transfer belt.

2. The image forming apparatus of claim 1, wherein the initial tension T at the time that the intermediate transfer belt is stretched arises due to elastic deformation of the intermediate transfer belt itself resulting from the intermediate transfer belt being wrapped around and stretched between the photoconductor drum and the plurality of support rolls whose shaft positions are fixedly disposed, and an initial elongation of the intermediate transfer belt in a state where the intermediate transfer belt is wrapped around and stretched between the support rolls and the photoconductor drum is greater than or equal to 5.2% and less than or equal to 32.1%.

3. The image forming apparatus of claim 1, wherein the contact member includes a cleaning member that cleans the intermediate transfer belt.

4. The image forming apparatus of claim 1, wherein the contact member includes a transfer roll that causes a toner image to be transferred from the intermediate transfer belt to a recording medium.

5. The image forming apparatus of claim 1, wherein the intermediate transfer belt includes a primary transfer portion that contacts the photoconductor drum in a wrapped manner, is wrapped around a predetermined range of the photoconductor drum, and is driven by the rotation of the photoconductor drum.

6. The image forming apparatus of claim 1, wherein the circumference of the intermediate transfer belt in a state where the intermediate transfer belt is wrapped around and stretched between the support rolls and the photoconductor drum is an integral multiple of the circumference of the photoconductor drum.

7. An image forming apparatus comprising:

a photoconductor drum;

an intermediate transfer belt that is wrapped around and stretched between the photoconductor drum and a plurality of support rolls and is driven by the photoconductor drum; and a contact member that contacts the intermediate transfer belt, wherein the image forming apparatus satisfies the following expression (2)

$$2T(e^{\mu\theta}-1)/(e^{\mu\theta}+1)+N(e^{\mu\theta}-1)/\theta>F \text{ and } T\leqq 396.9\text{ N} \quad (2),$$

wherein

μ represents a coefficient of friction between the photoconductor drum and the intermediate transfer belt, T represents an initial tension of the intermediate transfer belt, θ represents a wrap angle of the intermediate transfer belt on the photoconductor drum, F represents a load in a tangential direction applied from the contact member to the photoconductor drum via the intermediate transfer belt, and N represents an electrostatic suction force between the photoconductor drum and the intermediate transfer belt.

8. The image forming apparatus of claim 7, wherein the initial tension T at the time that the intermediate transfer belt is stretched arises due to elastic deformation of the intermediate transfer belt itself resulting from the intermediate transfer belt being wrapped around and stretched between the photoconductor drum and the plurality of support rolls whose shaft positions are fixedly disposed, and an initial elongation of the intermediate transfer belt in a state where the intermediate transfer belt is wrapped around and stretched between the support rolls and the photoconductor drum is greater than or equal to 2.5% and less than or equal to 32.1%.

9. The image forming apparatus of claim 7, wherein the contact member includes a cleaning member that cleans the intermediate transfer belt.

10. The image forming apparatus of claim 7, wherein the contact member includes a transfer roll that causes a toner image to be transferred from the intermediate transfer belt to a recording medium.

11. The image forming apparatus of claim 7, wherein the intermediate transfer belt includes a primary transfer portion that contacts the photoconductor drum in a wrapped manner, is wrapped around a predetermined range of the photoconductor drum, and is driven by the rotation of the photoconductor drum.

12. The image forming apparatus of claim 7, wherein the circumference of the intermediate transfer belt in a state where the intermediate transfer belt is wrapped around and stretched between the support rolls and the photoconductor drum is an integral multiple of the circumference of the photoconductor drum.

* * * * *